United States Patent [19]

Gerritsen

[11] 4,214,855

[45] Jul. 29, 1980

[54] PERISTALTIC TYPE PUMP

[76] Inventor: Jan W. Gerritsen, Raadhuisstraat 75, Alphen an der Rijn, Netherlands

[21] Appl. No.: 920,489

[22] Filed: Jun. 29, 1978

[30] Foreign Application Priority Data

Dec. 21, 1977 [NL] Netherlands ..... 7714189

[51] Int. Cl.[2] ..... F04D 43/12; F24B 45/08

[52] U.S. Cl. ..... 417/477

[58] Field of Search ..... 417/474, 475, 476, 477

[56] References Cited

U.S. PATENT DOCUMENTS

| | | | |
|---|---|---|---|
| 1,596,933 | 8/1926 | Kister et al. | 417/476 |
| 2,849,962 | 9/1958 | Musser | 417/476 |
| 3,011,684 | 12/1961 | Corneil | 417/477 |

FOREIGN PATENT DOCUMENTS

| | | | |
|---|---|---|---|
| 7513462 | 5/1977 | Netherlands | 417/477 |
| 1031595 | 6/1966 | United Kingdom | 417/477 |

*Primary Examiner*—Richard E. Gluck

*Attorney, Agent, or Firm*—Weingarten, Maxham & Schurgin

[57] ABSTRACT

A peristaltic type pump comprising a pump housing having a circular supporting track for a pump hose and a member mounted rotatably within the pump housing. The member has at two diametrically opposite points, seen in radial direction, dimensions that are substantially equal to the internal radius of the supporting track reduced by the thickness of the pump hose in squeezed shut condition. The rotatable pumping member has a substantially elliptical shape, while the pump hose can be squeezed shut by flattened portions of the pumping member which are substantially perpendicular to the ends of the major axis of said ellipse. The lengths of said portions in tangential direction is substantially equal to the internal diameter of the pump hose, while said flattened portions are adapted for sliding movement over the pump hose when the pumping member is rotating.

4 Claims, 3 Drawing Figures

PERISTALTIC TYPE PUMP

The present invention relates to a peristaltic type pump comprising a pump housing having a circular supporting track for a pump hose and a member rotatably disposed within said pump housing, said member having at two diametrically opposite points, seen in radial direction, dimensions that are substantially equal to the internal radius of the supporting track reduced by the thickness of the pump hose in squeezed shut state.

Such peristaltic type pumps are frequently used for pumping substances or materials with abrasive particles. The rotatably mounted pumping or delivery member in these prior art pumps comprises two pressure rollers disposed on such a member by means of hinge pieces, which rollers, upon rotation of the delivery member, roll over the hose of the peristaltic type pump while locally squeezing the same shut. In principle these pressure rollers may be so adjusted that they squeeze shut the hose according to a describing line of the pressure roller, but in practice it appears that this is insufficient and that in such case substantial leakage losses occur. In practice the pressure rollers are therefore so adjusted that they not only squeeze shut the hose but also compress the hose over a specific distance in order to avoid these leakage losses. This compression of the peristaltic type pump against the usually substantial resistance of the rubber hose requires additional power and is detrimental to the life of the hose. The hose is always locally upset and the pressure roller needs not only to supply delivery pressure but also the pressure for compressing the hose. Furthermore a thus constructed pressure member comprises a plurality of parts that, true, are not complicated in themselves but which render the pressure member an expensive part as a result of the assembly operations required.

It is the object of the present invention to eliminate these objections and the invention is characterized therefore in that the rotatable pumping member has a substantially elliptical shape, whereby the pump hose can be squeezed shut by bearing surfaces on the pumpimg member which are substantially flattened in the circumferential direction. It may also be stated that these surfaces are substantially perpendicular to the ends of the major axis of the ellipse. The length of the bearing surfaces in the circumferential or tangential direction is substantially equal to the internal diameter of the pump hose, and these surfaces advance slidingly over the pump hose when the pumping member rotates.

By imparting an elliptical or oval shape to the pumping member and moreover by causing the member to slide instead of to roll over the hose, it is possible to squeeze the pump hose shut over a specific width without it being necessary to compress and consequently to upset the pump hose itself. It was found that with a circumferential length of the bearing surfaces about equal to the internal diameter of the hose, at a delivery pressure of about 10 atmosphere, substantially no backflow occurs and as a result there are no leakage losses. Although the resistance during the sliding movement of the bearing surfaces over the pumping hose is larger in principle than the roller resistance during the rolling movement of pressure rollers over the hose, it appears that after a proper lubrication the power consumption of the pump will be reduced, since the compression and as a result the upsetting of the hose no longer occurs.

The elliptical or oval pumping member may be designed as a casting. However, the rotatable pumping member is preferably composed of a circular disc having a radius that is substantially equal to the internal radius of the supporting track minus the outer diameter of the pumping hose, on which disc there are disposed diametrically opposite, substantially sickle-shaped slidingly pieces, the bearing surfaces of which are disposed on the convex outer side of said sliding pieces.

In order to adjust the position of the sliding pieces relative to the circular pumping disc and to also adjust their position relative to the supporting track of the pump housing, the sliding pieces, at the side facing the circular pump disc, have a smaller radius of curvature than that of the circular pump disc itself. Between each sliding piece and the circumferential surface of the pump disc there may be disposed packing sheets variable in thickness. In each sliding piece there is an internally threaded bush for tightening the sliding piece and the packing sheets, if any, on the pump disc.

It is thus attained that no slot is formed at the transition between sliding piece and circular pump disc irrespective of the presence of spacing sheets between circular pump disc and sliding piece.

By designing the pumping or pressure member of the peristaltic type pump as described in the above, there is obtained in situ of the circular pressure disc in the pump housing a substantial space around the rotational axis of the pumping member, since the pressure disc needs only to consist of a plurality of spokes, while in the prior art pump a substantial space is occupied by the pressure rollers and the hinge pieces whereon the pressure rollers are mounted. Said resulting space can be very conveniently used by providing the pump housing wall facing towards the reduction casing with a recessed central portion having a height of about half the hub width of the pressure member, which is mounted in the housing of the peristaltic pump in such a way that the centre line of the hose in the peristaltic pump lies substantially in a plane going through the end face of the reduction casing, or at a short distance therefrom. Instead of the prior art construction wherein the peristaltic pump is mounted with a side wall on the end face of e.g. a reduction gearbox, it is not possible to construct the pump housing of the peristaltic pump around the reduction casing, so that for instance in the pump house wall opposite the reduction casing it is not necessary to dispose a bearing support so that the wall may consist of a flat plate.

Some embodiments of the peristaltic type pump according to the invention will now be explained, by way of example, with reference to the accompanying drawings, wherein.

Figure 1:
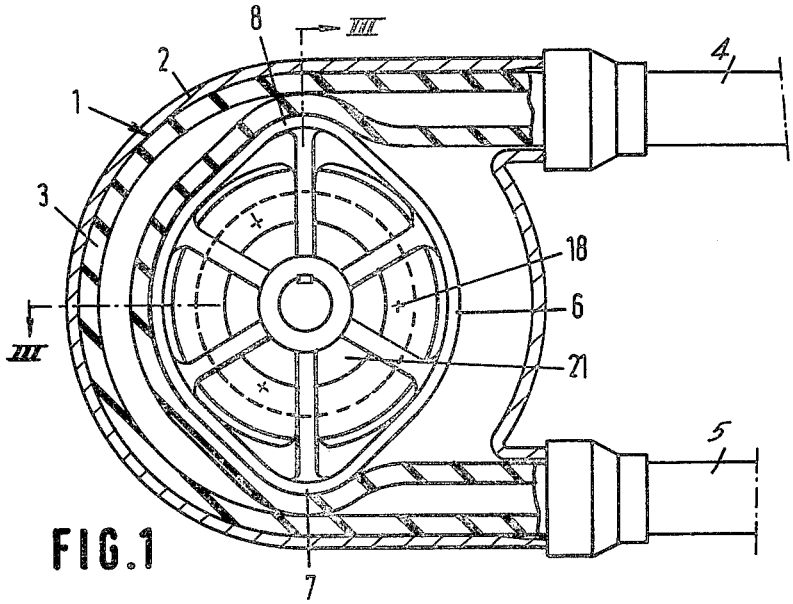
FIG. 1 shows a vertical cross-section of a peristaltic type pump according to the invention having a pressure member of a monolith structure.

FIG. 1 shows a more or less diagrammatic view of a peristaltic type pump according to the invention. Such a pump in reality has for instance an external diameter of 35 cm, with an internal pump hose diameter of 25 mm and a total weight of 30 kg. The capacity of such a pump is 900 liters at 50 revolutions per minute.

Such a pump comprises a pump housing 1, provided with a supporting track 2 for the pump hose 3. By 4 is indicated the inlet end of the pump hose 3 at the suction side of the pump; by 5 is indicated the outlet end of the pump hose 3 at the delivery side of the pump. On the central shaft of the pump housing there is mounted a rotatable pumping or pressure member 6, which is of elliptical or oval design and which is provided at two diametrically opposite points with pressure portions 7,8. Upon rotation of the pumping member 6 the portions 7,8 slide over the outer wall of the hose and squeeze these shut locally. Naturally, the pump housing is entirely closed and a suitable lubricant is present therein. For the prior art pressure roller pump usually glycerin was used as lubricant. For the peristaltic type pump having a sliding pressure member 6 preference is given to ethylene glycol as lubricant.

Figure 2:
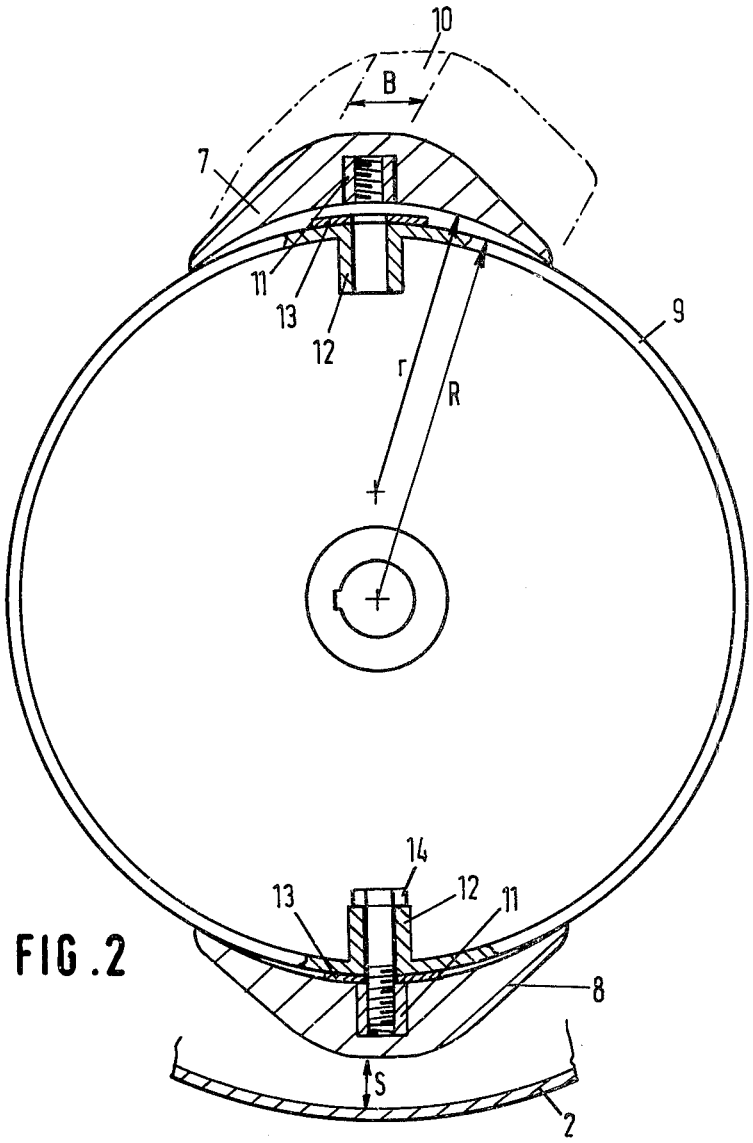
FIG. 2 shows details of a pressure member according to the invention consisting of parts.

The pressure member 6 may be designed in principle as casting or pressing. The finishing of the interior of the pressing member 6 however is not simple in such case in view of the particular shape of said pressure member 6. Preferably there is therefore applied a pressure member as shown in FIG. 2.

The composite pressure member comprises a circular disc 9, the radius R of which is equal to the internal radius of the supporting track 2 minus the outer diameter of the pump hose 3. The sliding pieces 7 and 8 are mounted diametrically opposite each other on the circular pressure disc 9. Said sliding pieces have a flattened bearing surface 10, the width B of which is in principle substantially equal to the internal diameter of the employed pump hose.

The sliding pieces 7 and 8 usually consist of a suitable rubber material and have a substantially sickle-shaped cross-section. The radius of curvature r of the side of the sliding piece 7 facing towards the circular pressure disc 9 is smaller than the radius R of said circular pressure disc 9. Consequently, there is present between a sliding piece 7 and the outer circumference of the disc 9 a space wherein spacer sheets 13 of variable thickness can be disposed, so that the distance S between the bearing surface 10 of each sliding piece 7,8 and the inner wall of the supporting track 2 can be adjusted or re-adjusted. In the sliding pieces 7,8 there is mounted an internally threaded bush 11, while the circular pressure disc 9 is provided at the inner side with two guiding bushes 12 wherein a bolt 14 can be inserted, so that the sliding pieces 7,8 can be properly tightened on the pressure disc 9. By the radius of curvature difference $R-r$, the formation of a slot between the sliding pieces 7,8 and the pressure disc 9 at the transition place can be avoided. A radius of curvature difference $R-r$ of 5 mm appears to provide a sufficiently broad re-adjustability range in practice.

The application of separate sliding pieces 7,8 has the additional advantage that in case of damage or wear, the sliding pieces can be simply exchanged, while the original pressure disc 9 is naturally preserved.

Figure 3:
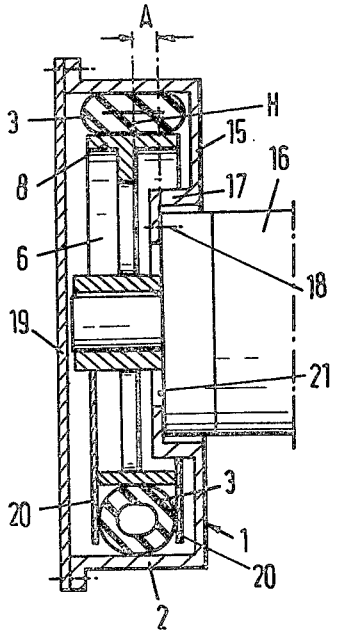
FIG. 3 is a cross-section on the line III—III shown in FIG. 1, in particular showing the construction of the pump housing.

The embodiment of the pressure member as described in FIGS. 1 and 2, permits the design of the pump housing as shown in FIG. 3. The wall 15 of the pump house 1 facing towards the reduction casing 16 is thereby provided with a recess portion 17 having a height or depth that is substantially equal to half the hub width of the pressure member 6.

The wall 15 of the pump housing 1 is secured by means of bolts 18 on the end face 21 of the casing 16 of a speed reduction mechanism so that, in comparison with the prior art construction, the working face or the face through the centre line H of the hose 3 is shifted in the direction of the reduction casing 16. In principle the distance A between the centre line H and the end face 21 of the reduction casing is kept as small as possible. The hub of pumping member 6 is then pushed on the shaft journal of the reduction casing 16 and need not be rotatably mounted to wall 19 of the pump housing facing away from the reduction casing 16. This provides a substantial simplification as compared to the conventional pump housing construction. The pump housing is naturally filled with a lubricant, for which ethylene glycol is preferably used, which has excellent lubrication properties for this application. By 20 are indicated guide plates which can be mounted on the pumping member 6 on the circumferential portions circumferentially situated between the sliding pieces 7,8 for guiding and positioning the pump hose 3 in the pump housing 1.

According to the invention there is obtained a peristaltic type pump wherein only one rotary portion is present and wherein furthermore no other moving or sealing parts are applied. Only the reduction casing has a built-in double sealing ring. The machining and mounting cost required for the prior art pumps are substantially non-existent while bearings and sealings in the closure wall or cover of the pump housing are likewise superfluous. In this manner substantial cost reductions can be obtained that lie in the order of 25% as compared to the prior art pump having rotary pressure rollers.

I claim:

1. A peristaltic type pump comprising:

a pump housing;

a circular supporting track mounted within said housing;

a pump hose positioned within said track; and a pumping member rotatably mounted within said housing, said pumping member having a substantially elliptical shape and being formed at two diametrically opposite points with sliding pieces having radial dimensions which are substantially equal to the internal radius of said supporting track reduced by the thickness of said pump hose in the squeezed shut condition, said sliding pieces having flattened bearing surfaces adapted to squeeze said pump hose shut, said bearing surfaces being substantially perpendicular to the ends of the major axis of said substantially elliptical shaped member, the circumferential lengths of said bearing surfaces being substantially equal to the internal diameter of said pump hose, bearing surfaces being adapted for sliding movement over said pump hose when said pumping member rotates, said pumping member comprising:

a circular disc having a radius substantially equal to the internal radius of said supporting track minus the outer diameter of said pump hose, said sliding pieces being individual sickle-shaped elements mounted on said disc in diametrically opposed relationship, said flattened bearing surfaces being disposed on the convex exterior surface of each said sliding piece, the surface of each said sliding piece facing said disc having a radius of curvature which is smaller than that of said disc;

at least one spacer sheet positioned between said disc and said facing surface of said sliding piece, the thickness of said sheet being variable;

an internally threaded bush mounted in said sliding piece; and a bolt engaging said disc and threadedly engaging said bush in said sliding piece and holding said sliding piece and said spacer sheet onto said disc.

2. A peristaltic type pump comprising:

a pump housing formed with a first side wall;

a circular supporting track mounted within said housing;

a pump hose positioned within said track;

a pumping member rotatably mounted within said housing, said pumping member having a substantially elliptical shape and being formed at two diametrically opposite points with sliding pieces having radial dimensions which are substantially equal to the internal radius of said supporting track reduced by the thickness of said pump hose in the squeezed shut condition, said sliding pieces having flattened bearing surfaces adapted to squeeze the pump hose shut, said bearing surfaces being substantially perpendicular to the ends of the major axis of said substantially elliptical shaped member, the circumferential lengths of said bearing surfaces being substantially equal to the internal diameter of said pump hose, said bearing surfaces being adapted for sliding movement over said pump hose when said pumping member rotates, said pumping member comprising:

a circular disc having a radius substantially equal to the internal radius of said supporting track minus the outer diameter of said pump hose; and said sliding pieces being individual sickle-shaped elements mounted on said disc in diametrically opposed relationship, said flattened bearing surfaces being disposed on the convex exterior surface of each said sliding piece; and a speed reduction mechanism casing mounted in said first side wall, said mechanism being drivingly coupled to said pumping member by means of a bearing within said housing, said first side wall being formed with an externally facing recessed central portion to receive said casing, the depth of said recess being substantially half the axial width of said pumping member, the center line of said hose being substantially in a plane through the end of said bearing at the inner end of said casing.

3. A peristaltic type pump comprising:

a pump housing formed with a first side wall;

a circular supporting track mounted within said housing;

a pump hose positioned within said track;

a pumping member rotatably mounted within said housing, said pumping member having a substantially elliptical shape and being formed at two diametrically opposite points with sliding pieces having radial dimensions which are substantially equal to the internal radius of said supporting track reduced by the thickness of said pump hose in the squeezed shut condition, said sliding pieces having flattened bearing surfaces adapted to squeeze the pump hose shut, said bearing surfaces being substantially perpendicular to the ends of the major axis of said substantially elliptical shaped member, the circumferential lengths of said bearing surfaces being substantially equal to the internal diameter of said pump hose, said bearing surfaces being adapted for sliding movement over said pump hose when said pumping member rotates;

said pumping member comprising:

a circular disc having a radius substantially equal to the internal radius of said supporting track minus the outer diameter of said pump hose;

said sliding pieces being individual sickle-shaped elements mounted on said disc in diametrically opposed relationship, said flattened bearing surfaces being disposed on the convex exterior surface of each said sliding piece, the surface of each said sliding piece facing said disc having a radius of curvature which is smaller than that of said disc;

at least one spacer sheet positioned between said disc and said facing surface of said sliding piece, the thickness of said sheet being variable;

an internally threaded bush mounted in said sliding piece; and a bolt engaging said disc and threadedly engaging said bush in said sliding piece and holding said sliding piece and said spacer sheet onto said disc; and a speed reduction mechanism casing mounted in said first side wall, said mechanism being drivingly coupled to said pumping member by means of a bearing within said housing, said first side wall being formed with an externally facing recessed central portion to receive said casing, the depth of said recess being substantially half the axial width of said pumping member, the center line of said hose being substantially in a plane through the end of said bearing at the inner end of said casing.

4. The peristaltic type pump recited in either of claims 2 and 3 wherein said housing is formed with a second side wall on the opposite side of said pumping member from said casing, said second side wall being substantially flat and spaced from said pumping member.

* * * * *